US007395562B2

(12) United States Patent
Ricketts

(10) Patent No.: US 7,395,562 B2
(45) Date of Patent: Jul. 8, 2008

(54) DETACHABLE HOOD FOR PATIENT RESCUE BAG

(76) Inventor: Robert A. Ricketts, P.O. Box 1, Poison, MT (US) 59860

( * ) Notice: Subject to any disclaimer, the term of this patent is extended or adjusted under 35 U.S.C. 154(b) by 217 days.

(21) Appl. No.: 11/364,762

(22) Filed: Feb. 28, 2006

(65) Prior Publication Data

US 2007/0199148 A1 Aug. 30, 2007

(51) Int. Cl.
*A47G 9/08* (2006.01)

(52) U.S. Cl. ..... 5/413 R; 5/627; 2/69.5; 2/84; 2/202

(58) Field of Classification Search ..... 5/413 R, 5/413 AM, 625–628; 2/69.5, 88, 69, 80, 2/83, 85, 95, 84, 202, 204
See application file for complete search history.

(56) References Cited

U.S. PATENT DOCUMENTS 1,952,465 A * 3/1934 Rycroft ..... 2/69.5
2,372,110 A * 3/1945 Noone ..... 2/84
2,439,382 A * 4/1948 De Grazla ..... 2/84
2,967,306 A * 1/1961 Fabanich ..... 2/94
3,178,734 A 4/1965 Carrez
3,510,889 A 5/1970 Peterson
3,962,738 A 6/1976 Menditto
4,124,908 A 11/1978 Burns et al.
4,183,111 A 1/1980 Zahavkochav
4,513,461 A 4/1985 Tardivel
4,790,040 A * 12/1988 Grilliot et al. ..... 5/413 R
5,005,235 A 4/1991 Huang
5,086,530 A 2/1992 Blake
5,142,704 A * 9/1992 Viemeister et al. ..... 2/202
5,189,746 A 3/1993 Horie
5,193,235 A 3/1993 Kircher
5,339,466 A * 8/1994 McMullen ..... 2/203
5,386,604 A 2/1995 Ricketts
5,815,833 A * 10/1998 Kuo ..... 2/69.5
5,839,137 A 11/1998 Butler et al.
6,061,853 A 5/2000 Laaksonen et al.
6,128,796 A 10/2000 McCormick et al.
6,195,822 B1 3/2001 Sorensen et al.
6,199,232 B1 3/2001 Kocivar
6,241,653 B1 6/2001 Gauger et al.
6,370,692 B1 * 4/2002 Duyn et al. ..... 2/86
6,912,747 B2 7/2005 DuPree et al.

* cited by examiner

*Primary Examiner*—Alexander Grosz
(74) *Attorney, Agent, or Firm*—Greenebaum Doll & McDonald PLLC; Glenn D. Bellamy

(57) ABSTRACT

Shown is a detachable head covering unit for use with a generally rectangular patient rescue bag with an open head end and one part of a two-part quick connect/disconnect fastener device that extends proximally to and along transverse edges defining the open head end. The hood includes lower and upper substantially planar portions having inner surfaces, outer surfaces, perimeters each with an attachment portion, the attachment portions including a mating part of a two-part quick connect/disconnect fastener device that extends proximally to and along an edge thereof. The upper and lower portions are secured to one another along substantially their entire perimeters except at the attachment portion of the perimeter. A face opening is provided in the upper portion and the opening extends to and intersects the edge of the attachment portion such that separate parts of the edge are releasably secured together to form a substantially continuous attachment edge. The hood may include insulating and/or outer water-resistant layers.

6 Claims, 3 Drawing Sheets

DETACHABLE HOOD FOR PATIENT RESCUE BAG

TECHNICAL FIELD

This invention relates to detachable hood or head covering unit for use in conjunction with a patient rescue bag for maintaining body temperature of a person being transported from a remote location that is inaccessible to a transport vehicle.

BACKGROUND OF THE INVENTION

When a person is injured in a remote location, rescue workers often are required to hand carry the person on a stretcher to a location where an ambulance or helicopter can be reached. This is particularly true in remote locations consisting of rough terrain such as mountains, and in such circumstances the injured person would be exposed to the elements until the emergency rescue vehicle could be reached. A patient rescue bag for this purpose is described in my prior U.S. Pat. No. 5,386,604, issued Feb. 7, 1995, and in my pending patent application Ser. No. 11/343,438 filed Jan. 31, 2006 entitled Improved Patient Rescue Bag. The disclosure of both of these documents are hereby incorporated herein by reference. Rescue bags such as these are put to use in increasingly hostile environments, such as by the military or high altitude climbing expeditions. In these situations, an injured person may have to be held at one location for a significant period of time until it is safe for a transport vehicle to arrive on the scene or may be suffering from hypothermia. In such cases, it is desirable to be able to cover the patient's head securely while maintaining the ability to access any part of the patient's body for diagnosis or treatment.

One patient rescue bag may be used in differing situations or seasons, making it desirable to have the option of a head covering without it being in the way when not needed.

SUMMARY OF THE INVENTION

The present invention provides a detachable head covering unit for use with a generally rectangular patient rescue bag. The patient rescue bag has an open head end and one part of a two-part quick connect/disconnect fastener device extends approximately to and along transverse edges defining the open head end. The detachable head covering unit (hood) comprises a lower substantially planar portion having an inner surface, an outer surface, and a perimeter. A portion of the perimeter includes a mating part of a two-part quick connect/disconnect fastener device as an attachment mechanism and extends approximately to and along an edge thereof. There is also an upper substantially planar portion having an inner surface, an outer surface and a perimeter. A portion of this perimeter also includes a mating part of a two-part quick connect/disconnect fastener device as an attachment mechanism and also extends approximately to and along an edge thereof.

The upper and lower portions are secured to one another along substantially their entire perimeters, except at the attachment portions of their perimeters. There is a face opening in the upper portion which extends to and intersects the edge of the attachment portion of the upper portion perimeter. Separate parts of this edge of the upper portion are releasably secured together to form a substantially continuous attachment edge.

The face opening can include a draw string for adjusting its size. The upper and lower portions may include a layer of thermally insulating material and may also include an outer layer of water-resistant material.

The above summary of the present invention is not intended to describe each embodiment or every implementation of the present invention. Advantages and benefits, together with a more complete understanding of the invention, will become apparent and appreciated by referring detailed description and claims taken in conjunction with the accompanying drawings.

BRIEF DESCRIPTION OF THE DRAWING

Like reference numerals refer to like parts throughout the various figures of the drawing, wherein.

DETAILED DESCRIPTION

Figure 1:
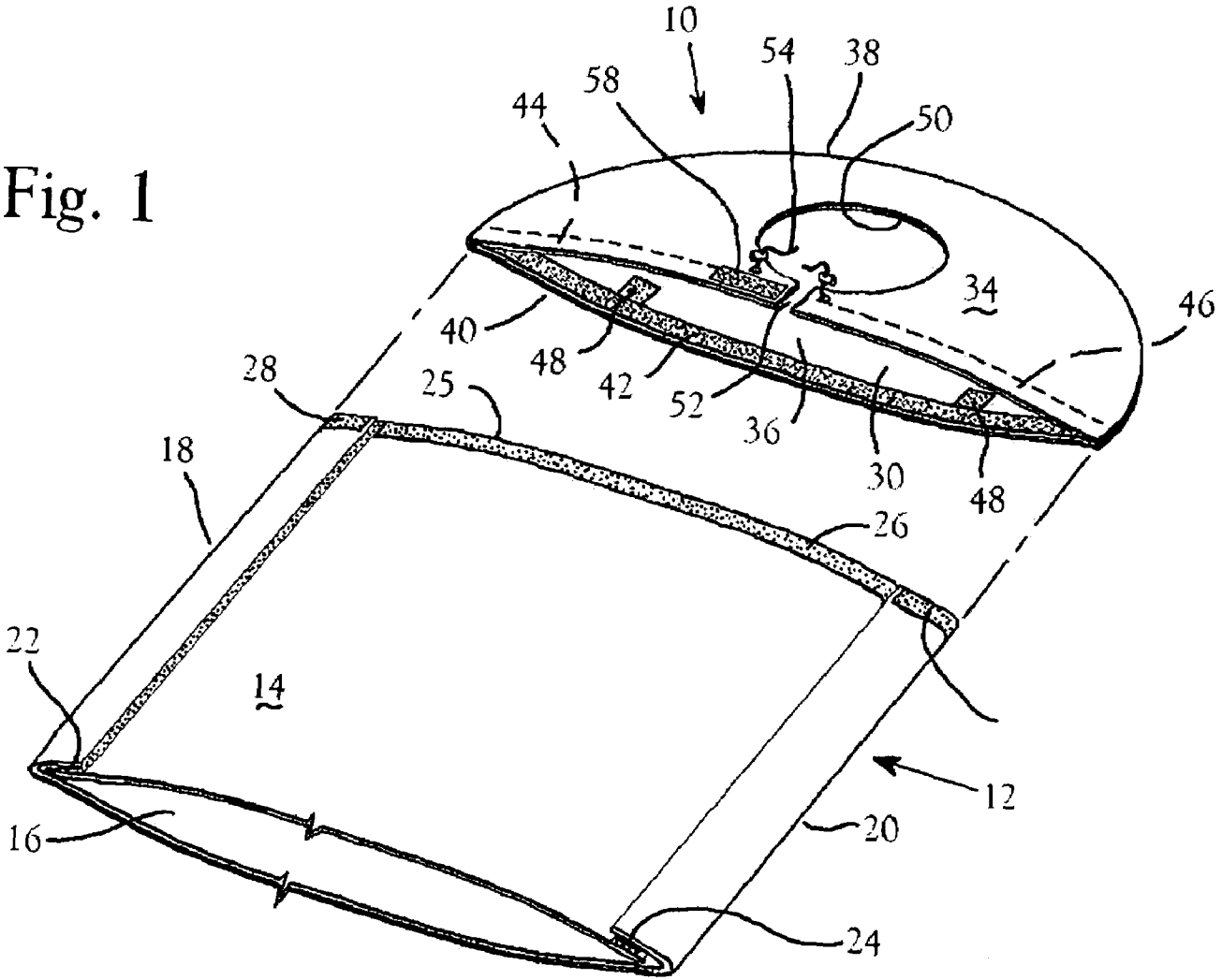
FIG. 1 is a pictorial view of a detachable hood according to a preferred embodiment of the invention and showing a portion of a patient rescue bag.
Figure 2:
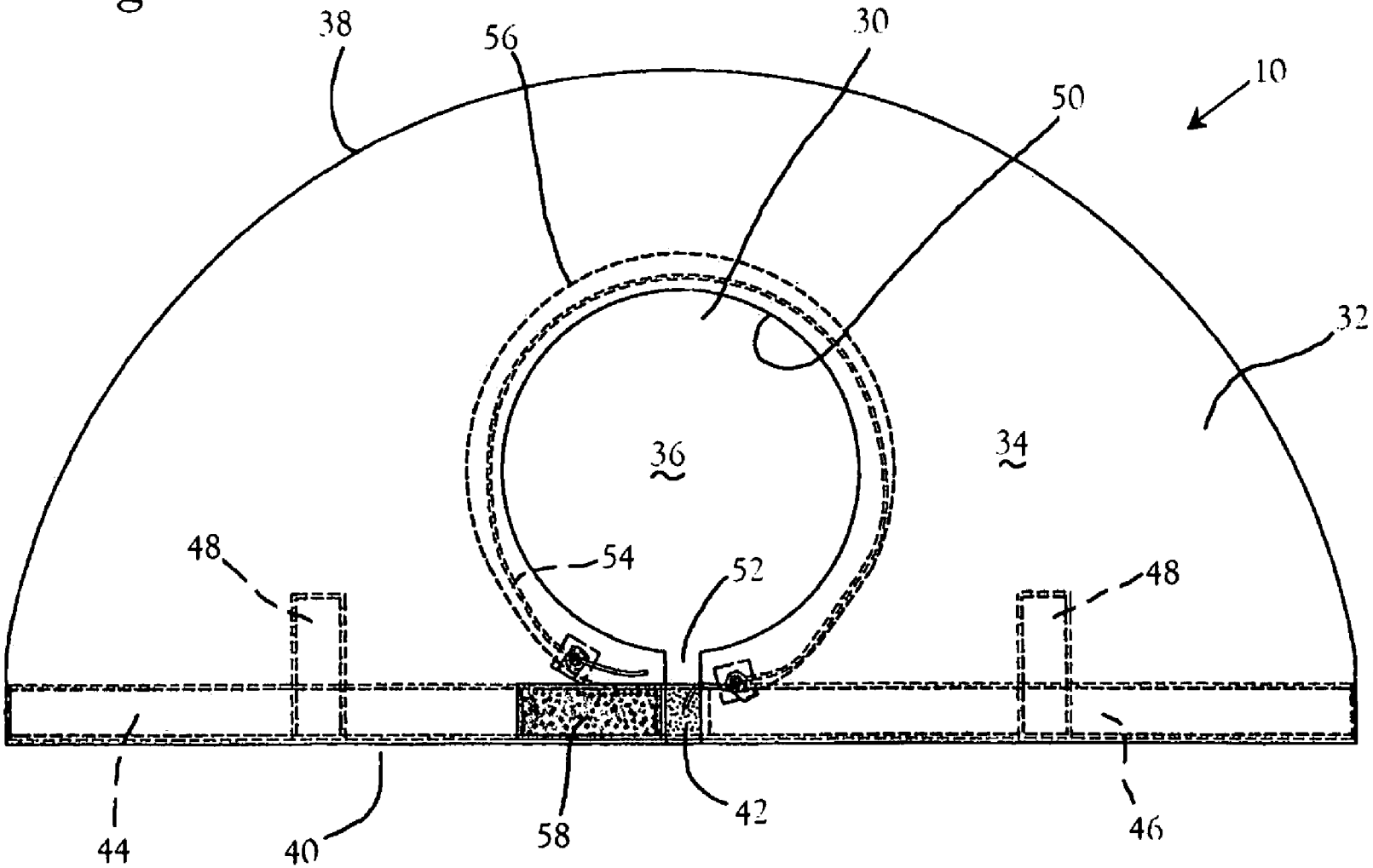
FIG. 2 is a plan view of the upper surface of the hood.

Referring to the various figures of the drawing, therein is shown at 10 a detachable head covering or hood according to a preferred embodiment of the invention for use with a patient rescue bag 12 of the type shown in my prior U.S. Pat. No. 5,386,604, issued Feb. 7, 1995, in my pending patent application filed Jan. 31, 2006, entitled Improved Patient Rescue Bag, or any other such product which includes an open head end with exposed edges of upper and lower layers.

The bag 12 provides a self-contained bedding system designed to provide patient access around its entire perimeter, while maintaining patient body temperature. In a rescue situation involving prolonged exposure prior to evacuation, extreme cold, high altitude, or hypothermia, the provision of a head or head and shoulders covering hood 10 to retain the large amount of body heat that can be lost from the head would be useful. Likewise, in order to maximize versatility and to allow full access to the patient's head once they are moved out of full weather exposure, easy removal or detachability of the hood 10 is also important.

A typical patient rescue bag 12 is generally rectangular in shape and sized to enclose a patient in a supine position. Although many variations and constructions are possible, the bag 12 will generally comprise an upper portion 14 and a lower portion 16 that are interconnected to one another in a releasable manner generally along longitudinal side edges 18, 20 and transversely at a foot end (not shown). The closure devices are generally and preferably elongated strips 22, 24 of interlocking hook and loop fasteners, such as VELCRO®.

One component of a two-part quick connect/disconnect fastener device may be provided to extend transversely along head end edges 25 of the bag 12 as shown at 26, 28, on both the upper 14 and lower 16 portions. While this could be a series of snaps or one or more zippers, it is preferred that these components 26, 28 are the softer "loop" portion of a hook and loop fastener system, such as VELCRO®. Thus, when used without the hood 10, the relatively softer loop portion will not present an abrasive edge that may come in contact with the patients neck or chin that would be presented by the relatively stiffer "hook" component.

The hood 10 is made of substantially planar lower 30 and upper 32 portions. In preferred form, the outer surface 34 of both the lower 30 and upper 32 portions are constructed of a waterproof, flexible material such as STORM-TECH™ manufactured by Brookwood, located in Gardenia, Calif.

Inner surfaces 36 of both the lower and upper portions 30, 32 may be made from either the same material or a soft, washable fleece material such as Polartec®, made by Malden Mills. If desired, thermal insulating material (not shown) such as down or PRIMALOFT® (manufactured by Albany International) may be provided between the outer 34 and inner layers 36 of the lower and upper portions 30, 32.

Both the lower and upper substantially planar portions 30, 32 are secured to one another along their perimeters 38 by either sewing or gluing, except for an open attachment portion 40 that is sized and shaped to mate with and attach to the head end opening 25 of the bag 12.

In its simplest form, the attachment open portion 40 is transversely straight. Such other shapes as may be necessary to properly mate to the open head end 25 of a patient rescue bag 12 may be used as deemed necessary.

As shown in the illustrated embodiment, the hood 10 can be made in a substantially semi-circular shape so as to readily attach to the patient rescue bag 12 and to minimize unused material. Other shapes, including a rectangle, trapezoid, or other polygon may be utilized as well.

The preferred device for easy attachment/detachment is, as described above, strips of VELCRO® material 42, 44, 46 applied as by sewing or gluing to the interior surfaces of the hood 10 along the open attachment edges 40. As described above, the attachment device may be a series of snaps or zippers, but utilizing the hook component of VELCRO® strips 42, 44, 46 on the hood 10 to mate with strips of VELCRO® loop material 26, 28 on the bag 12 is preferred.

The interior surface 36 of the lower portion 30 may also include selectively placed pieces of one portion of another quick connect/disconnect fastener device 48 for holding in place an absorbent and liquid proof disposable liner (not shown) that may be used with a patient rescue bag 12 and extend beyond the head and opening of the bag 12. Generally, these small fastener devices 48 would be the hook portion of a VELCRO® strip.

The upper portion 32 includes a face opening 50 formed therein. The opening 50, which may be round, is either positioned to extend to or includes an opening extension 52 which intersects the edge of the attachment portion 40 of the upper portion 32. A draw string 54 may be provided substantially around the face opening 50 in a channel defined by a row of stitching 56 running substantially parallel to or concentric with the face opening 50.

Figure 3:
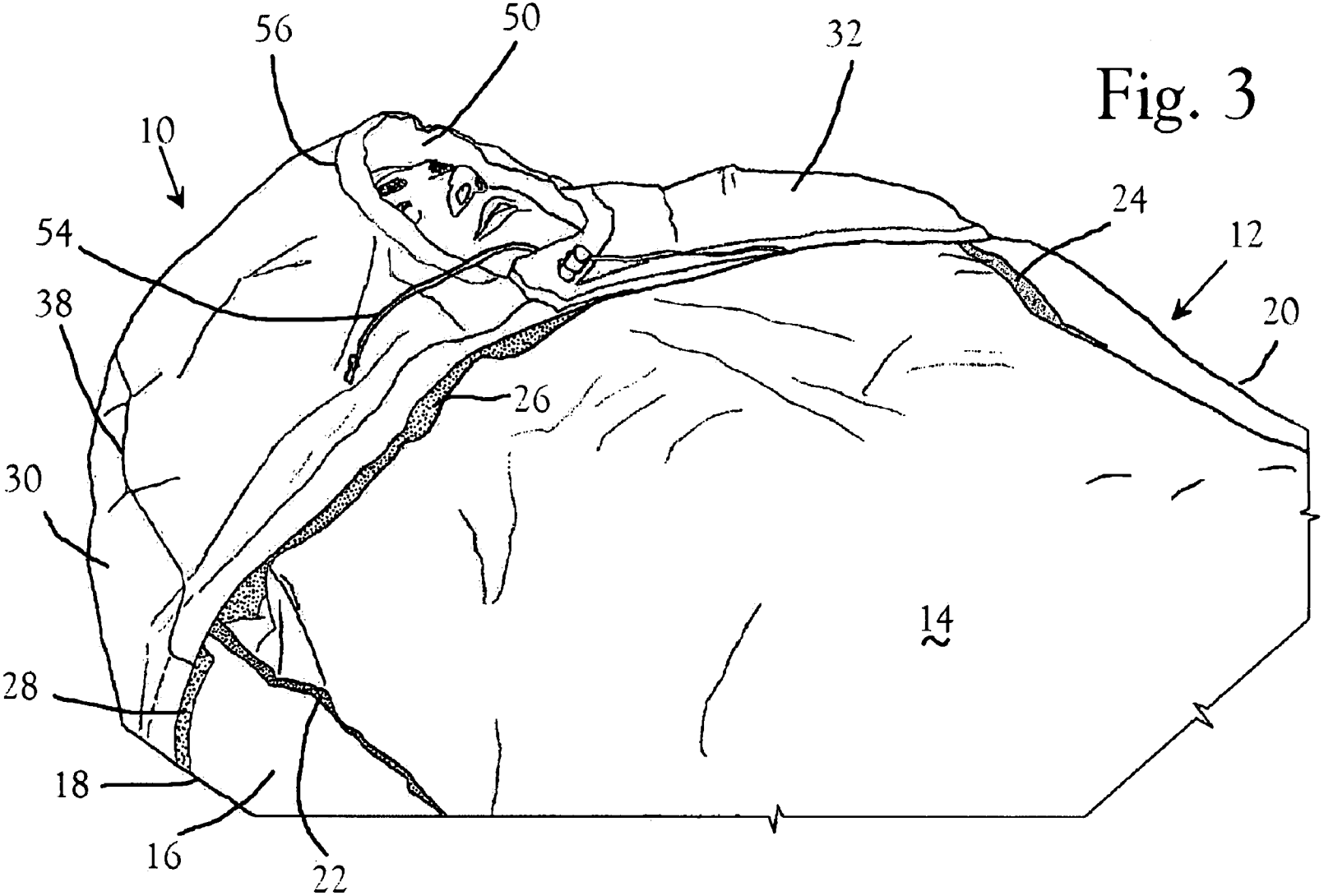
FIG. 3 is a pictorial view of the hood in use with a patient rescue bag.

Adjacent to the point where the face opening 50 or extension 52 intersects the attachment edge 40 of the upper portion 32 is another fastener device 58. This fastener device 58 may be a mating component of VELCRO® material which can be selectively engaged with the attachment strip (46 as shown) opposite the intersecting portion 52 of the face opening 50. As best shown in FIG. 3, the opposing side of the upper portion 32 can be overlapped to provide a complete enclosure of the face opening 50 and to form a substantially continuous attachment edge for securing the hood 10 to the patient rescue bag 12.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary and skill in the art to best utilize the invention in various embodiments and with various modifications as are suited to the particular use contemplated. It is intended that the scope of the invention be defined by the claims appended hereto.

What I claim is:

1. A detachable head covering unit for use with a generally rectangular patient rescue bag for a supine patient, the bag having anterior and posterior panels with an open head end and one part of a two-part quick connect/disconnect fastener device that extends proximally to and along transverse edges defining the open head end, comprising:

a lower substantially planar portion having an inner surface and, an outer surface, a perimeter with an attachment portion, the attachment portion including a mating part of a two-part quick connect/disconnect fastener device that extends proximally to and along an attachment edge thereof;

for attachment of the posterior panel of the patient rescue bag, the lower portion positioned to lie substantially flat and posterior to the patient's head;

an upper substantially planar portion having an inner surface, an outer surface, and a perimeter with an attachment portion, the attachment portion including a mating part of a two-part quick connect/disconnect fastener device that extends proximally to and along an attachment edge thereof for attachment to the anterior panel of the patient rescue bag;

the upper and lower portions being secured to one another along substantially their entire perimeters except at the attachment portions of their perimeters such that the upper portion will lie substantially flat on the lower portion when not in use, the upper and lower portions having a width substantially matching that of the patient rescue bag; and a face opening formed in the upper portion, said opening extending to and intersecting the edge of the attachment portion such that separate parts of the edge are releasably secured together to form a substantially continuous attachment edge.

2. The detachable head covering unit of claim 1, wherein the upper and lower portions include a layer of thermally insulating material.

3. The detachable head covering unit of claim 1, wherein the upper and lower portions include an outer layer of water-resistant material.

4. The detachable head covering unit of claim 1, wherein the quick connect/disconnect device is attached to the inner surface of the upper and lower portions for attachment to a mating part that is on an outer surface of the patient rescue bag.

5. The detachable head covering unit of claim 1, further comprising a drawstring substantially around edges of the face opening.

6. The detachable head covering unit of claim 1, wherein the separate parts of the upper portion edge intersected by the face opening are releasably secured together in an overlapping manner.

* * * * *

UNITED STATES PATENT AND TRADEMARK OFFICE

CERTIFICATE OF CORRECTION

PATENT NO. : 7,395,562 B2
APPLICATION NO. : 11/364762
DATED : July 8, 2008
INVENTOR(S) : Robert A. Ricketts It is certified that error appears in the above-identified patent and that said Letters Patent is hereby corrected as shown below:

Title page, item [75]
Inventor's address should read: P.O. Box 1, POLSON, MT (US) 59860

Signed and Sealed this

Sixteenth Day of September, 2008

JON W. DUDAS
*Director of the United States Patent and Trademark Office*